US006257251B1

(12) United States Patent
Burleson et al.

(10) Patent No.: US 6,257,251 B1
(45) Date of Patent: Jul. 10, 2001

(54) CUSHION COATED HAIR CLIP HAVING LOW-FRICTION SURFACES

(76) Inventors: Julie Lynn Burleson, 9502 Hidden Meadow Dr., Waco, TX (US) 76712; Suzanne Vinson Nettles, 213 Whispering Meadow, Hewitt, TX (US) 76653

( * ) Notice: Subject to any disclaimer, the term of this patent is extended or adjusted under 35 U.S.C. 154(b) by 0 days.

(21) Appl. No.: 09/659,118

(22) Filed: Sep. 11, 2000

(51) Int. Cl.[7] ..... A45D 8/22
(52) U.S. Cl. ..... 132/279
(58) Field of Search ..... 132/273, 275, 132/276, 277, 278, 279, 282; 24/300, 556

(56) References Cited

U.S. PATENT DOCUMENTS

| | | | | |
|---|---|---|---|---|
| 2,661,748 | * | 12/1953 | Racho | 132/275 |
| 2,767,721 | * | 10/1956 | Cockley | 132/279 |
| 3,590,830 | * | 7/1971 | Hannum | 132/278 |
| 4,844,103 | | 7/1989 | Vick | 132/245 |
| 5,477,870 | | 12/1995 | Menaged | 132/279 |
| 5,638,836 | | 6/1997 | Yasuda | 132/279 |
| 5,996,593 | * | 12/1999 | Horman | 132/277 |
| 6,116,251 | * | 9/2000 | Stachowski | 132/273 |

* cited by examiner

*Primary Examiner*—Todd E. Manahan
*Assistant Examiner*—David C. Comstock
(74) *Attorney, Agent, or Firm*—Dennis T. Griggs

(57) ABSTRACT

A hair clip includes a clasp and a leaf spring clamp connected on one end. A layer of a compressible, resilient cushion material such as natural rubber or elastomer synthetic resin material, or cellular plastic foam is bonded onto the hair engaging surfaces. A thin non-porous outer coating layer is applied to the compressible cushion layers for providing smooth, low-friction, non-sticking surfaces for directly engaging the hair. The hair clip easily attaches onto hair and is retained securely on the hair without slipping and without damaging the hair, and is easily removed from the hair without snagging.

11 Claims, 2 Drawing Sheets

CUSHION COATED HAIR CLIP HAVING LOW-FRICTION SURFACES

BACKGROUND OF THE INVENTION

This invention relates generally to hair clips and barrettes. More specifically, this invention relates to hair clips and barrettes that easily attach onto hair and remain securely attached without slipping or damaging the hair, and are easily removed from hair without snagging.

Hair is a slender, thread-like outgrowth from the scalp. Caring for hair is not only important to promote healthy hair growth, but also important for a person's self-esteem. Men and women arrange their hair in a variety of styles. In particular, a hair clip or barrette is often used to achieve a certain style or look, and as a retainer for holding a lock of hair.

The present invention aims to alleviate the problems associated with traditional hair clips and barrettes, namely, pinching or clasping the hair too tightly and entangling the hair on the clip or barrette, or clasping too loosely and sliding away. Conventional hair clips are shown in U.S. Pat. No. 3,590,830 to Hannum and U.S. Pat. No. 5,638,836 to Yasuda. The '830 Patent entitled "Barrette" discloses a barrette that has upper and lower clasp plates, with foam rubber cushion layers attached to the inside facing clasp surfaces that exert a high-friction grip. The '836 Patent entitled "Hair Clip" discloses an anti-slip mat on the hair engaging surface of a clip retainer plate which exerts a frictional resistance which improves retention. There is no suggestion in either ofthese patents for providing a smooth, low-friction, non-sticking cushion coated layer for directly engaging hair without damaging the hair and without snagging.

BRIEF SUMMARY OF THE INVENTION

The present invention relates to a hair clip which includes a pair of clamping members or clasps pivotally connected on one end. A layer of a compressible, resilient cushion material such as a natural rubber or elastomer synthetic resin material, or cellular plastic foam is attached to the facing surfaces of the clamping members. A thin, non-porous outer coating layer is applied to the compressible cushion layers thus providing a smooth, low-friction, non-sticking surface for directly engaging the hair. The hair clip easily attaches onto hair, remains securely on the hair without slipping or damaging the hair and is easily removed from the hair without snagging. Preferably, the low-friction layers are thermoplastic high density polyethylene blends having appropriate balance of crystalline, durability and flexibility.

BRIEF DESCRIPTION OF THE DRAWING

The accompanying drawing is incorporated into and forms apart of the specification to illustrate the preferred embodiments of the present invention. Various advantages and features of the invention will be understood from the following detailed description taken in connection with the appended claims and with reference to the attached drawing figures in which:

DETAILED DESCRIPTION OF THE INVENTION

Figure 1:
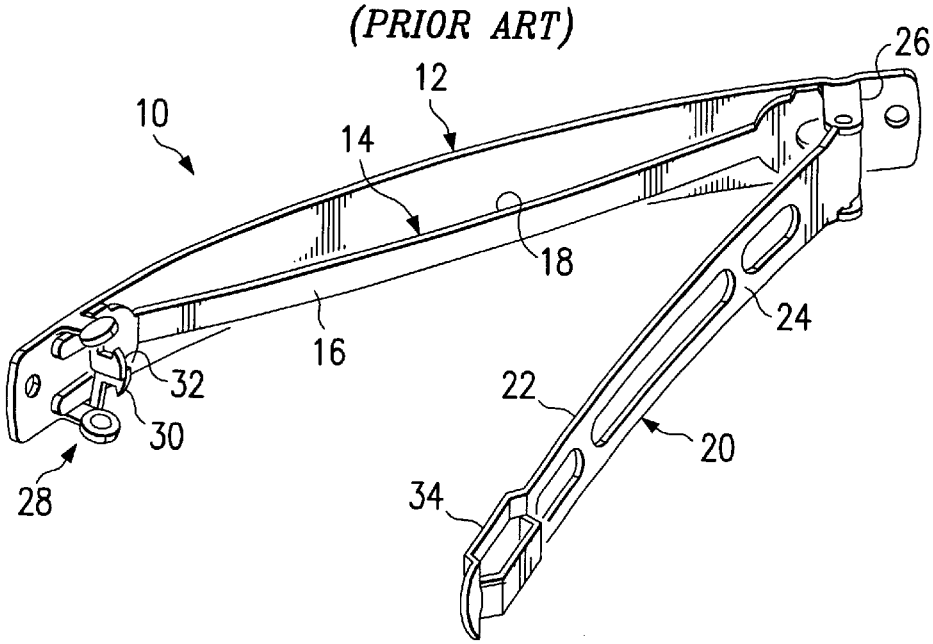
FIG. 1 (PRIOR ART)
FIG. 1 is a perspective view of a conventional hair clip.

Preferred embodiments of the invention will now be described with reference to an example showing how the invention can best be made and used. Like reference numerals are used throughout the description and several views to indicate like or corresponding parts.

Referring to FIG. 1, a conventional all-metal hair clip 10 is shown. Often, traditional hair clips and barrettes clasp the hair too tightly and entangle the hair on the engagement surfaces or else hold the hair too loosely, allowing the barrette to slip or fall away. The hair is difficult to get untangled from the clamping members. The process of untangling hair is slow and care should be taken to avoid stretching or breaking the hair as it is removed from the clip. The present invention overcomes the problems associated with traditional hair clips and barrettes, namely, pinching or clasping the hair too tightly, holding the hair too loosely, and entangling the hair on the hair clip or barrette.

Figure 2:
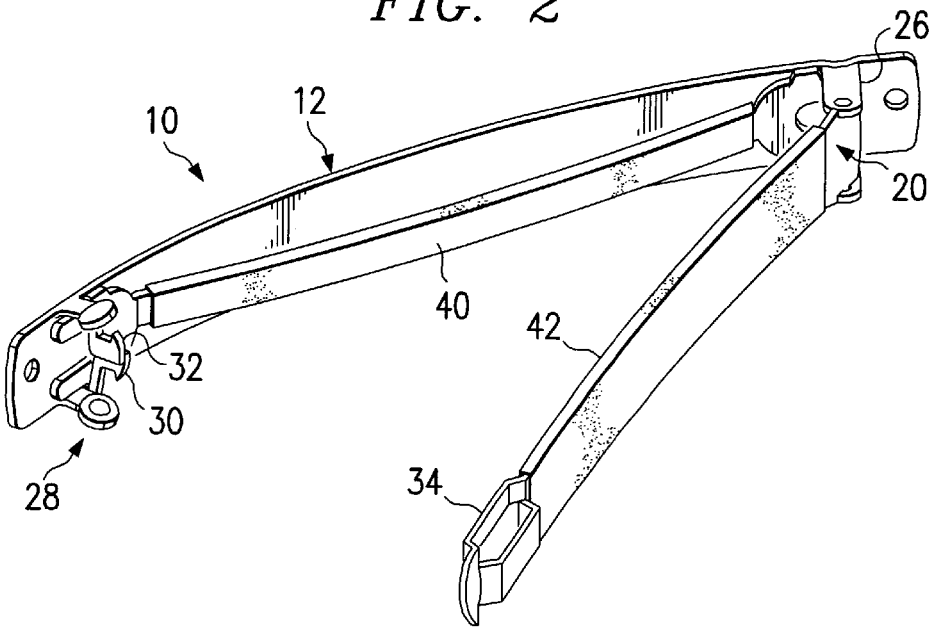
FIG. 2 is a perspective view of a conventional hair clip that has been modified according to the present invention.

Referring now to FIG. 1 and FIG. 2, the improvements of the present invention are incorporated in a conventional hair clip 10 which includes a first clasp plate 12, a leaf spring 14 having an inner clasping surface 16 and an outer surface 18, and a second clasp plate 20 having an inner clasping surface 22 and an outer surface 24. A hinge 26 pivotally connects the first clasp plate 20 to the second clasp plate 12. A latching member 28 on the first clasp plate 12 releasably engages the second clasp plate 20. The latching member 28 includes a pair of release tangs 30, 32 and the second clasp plate includes a bifurcated latch plate 34 that is engagable with the release tangs, according to conventional construction.

Figure 3:
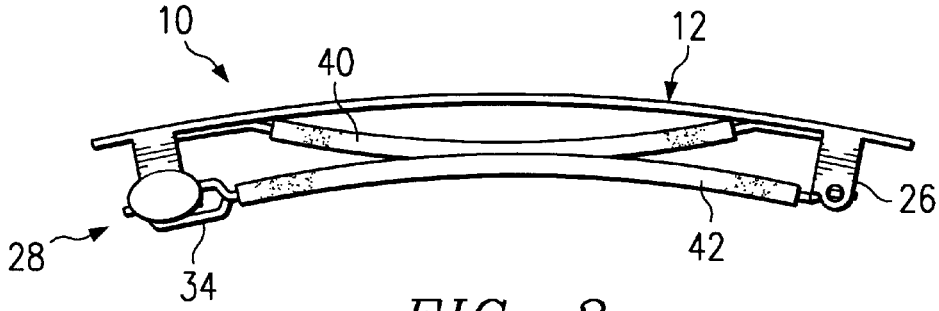
FIG. 3 is a side view illustrating the hair clip of FIG. 2 in a closed, hair engaging position.
Figure 4:
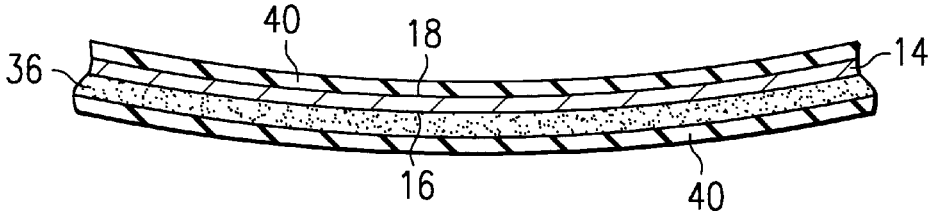
FIG. 4 is a cross-sectional view of a spring clamping member that has been modified according to the present invention; and, FIG. 5 is a cross-sectional view of a clasp plate that has been modified according to the present invention.
Figure 5:
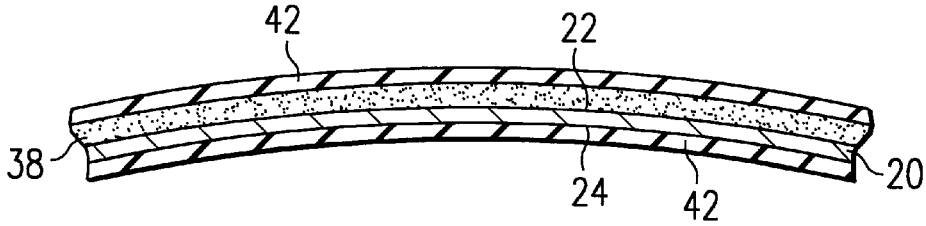

The leaf spring 14 and the second clasp plate 20 are movable together from an open position as shown in FIG. 1 to a closed position as shown in FIG. 3 for directly engaging a lock of hair. The leaf spring 14 and the second clasp plate 20 are referred to herein as first and second clamping members, respectively. According to the present invention, the surfaces of these two clamping members which come in contact with hair are covered with layers of soft cushion material. Each layer of cushion material is covered by a flexible layer or coating of low-friction material, which imparts a smooth, satin-like feel to the hair engaging surfaces.

Referring to FIG. 2, FIG. 3, FIG. 4 and FIG. 5, a first compressible layer 36 is disposed on the first inner clamping surface 16, and a second compressible layer 38 is attached to the second inner clamping surface 22. The first compressible layer 36 and the second compressible layer 38 each comprise a soft compressible plastic material, for example, a closed cell polyethylene foam. Preferably, the closed cell polyethylene foam is VOLARA Type EO Aliplast or PLASTAZOTE LD45.

A first low-friction layer 40 is disposed around the first compressible layer 36 and the outer surface 18 of the spring clamping member 14, and a second low-friction layer 42 is disposed around the second compressible layer 38 and the outer surface 24 of the clasp plate 20. Preferably, the first low-friction layer 40 and the second low-friction layer 42 are thermoplastic high density polyethylene (HDPE) blends having an appropriate balance of crystallinity, durability and flexibility. The first low-friction layer 3 8 and second low-friction layer 40 each have a coefficient of friction (COF) relative to glass in the range of 0.18 to 0.26 as measured in accordance with ASTM D 1894.

Since abrasion-resistance increases with increased density or increased molecular weight, high density polyethylene, with minimum density of 0.945, are preferred for forming the first low-friction layer 40 and second low-friction layer 42. The preferred density ranges are between 0.950 and 0.970 with the density of about 0.952 most preferred.

High density polyethylene polymers useful in the preparation of the low-friction layers 40, 42 of the invention range molecularly from about 1,000 to about 4,000,000, preferably from about 100,000 to about 800,000.

In the preferred embodiment of the invention, good abrasion-resistance and low coefficient of friction are achieved with a blend of high density polyethylene. Blends used in the practice of the invention include bimodal molecular weight distribution (MWD), high density polyethylenes. Such bimodal MWD HTPEs have a high molecular weight component and a low molecular weight component. The high molecular weight component ranges in molecular weight from about 100,000 to about 4,000,000, preferably from about 100,000 to about 800,000. The low molecular weight component ranges in molecular weight from about 1,000 to about 50,000, preferably from about 10,000 to about 50,000. The high molecular weight component imparts both abrasion resistance as well as toughness. The low molecular weight component contributes to processability.

In the preferred embodiment of the invention, the above described bimodal polymer is combined with a medium molecular weight HTPE having a molecular weight ranging from about 50,000 to about 100,000, preferably from about 80,000 to about 100,000. This medium MW HTPE is added to enhance melt flow rates during processing. The amount of high molecular weight component and the blend of HTPE can range from 10% to 80% by weight, preferably 10% to 60%, most preferably about 15%–25%. The amount of medium molecular weight component, if present, and the blend of HTPE ranges from about 0 to about 80%, more preferably about 20%–70%, and most preferably about 55% to about 65%. The balance of HTPE is made up of a low molecular weight component.

To impart coating flexibility elasticity, the above recited abrasion-resistant polymers are blended with elastomers. Elastomers useful in the practice of the invention are ethylene/propylene rubbers (EPR) (such as Vistalon 503 brand EPR) and blends of ethylene/propylene rubbers with HTPE. Blends useful in the practice of the invention are blends of EPR and HTPE, wherein the amount of EPR ranges from about 99% to about 50% EPR. The ratio of HTPE or HTPE blends to elastomer ranges from about 3:1 to about 19:1, preferably about 9:1 by weight.

The fabrication process for modifying a conventional hair clip 10 will now be described in more detail. Assuming that the hair clip 10 has an arc length of about 10 cm, the first compressible layer 36 is formed by wrapping a 6 cm (length) ×2 cm (width) ×3 mm (thickness) sheet of soft compressible plastic material, for example closed cell foam, as described above, around the inner clasping surface 16 by an adhesive or cement. Preferably, the soft compressible plastic material is secured by an epoxy. Similarly, the lower compressible layer 38 is formed by wrapping a 6 cm (length)×1 cm (width)×3 mm (thickness) sheet of soft compressible plastic material of the type described above and attaching it by an adhesive or cement to the lower inner surface 22. Preferably, the compressible layers 36, 38 are secured by an epoxy deposit.

Next, the first low-friction layer 40 is formed by heating a 6 cm (length) ×1 cm (width)×4 mils (thickness) sheet of low-friction thermoplastic high density polyethylene material of the type specified above to a temperature such that it can be shaped as desired. The heated sheet is then wrapped around upper compressible layer 36 and upper outer surface 38. A vacuum draws down the first low-friction layer 40 to conform to the shape of upper compressible layer 36 and upper outer surface 38. Then, the first low- friction layer 40 is allowed to cool and trimmed to shape. The second low-friction layer 42 is formed in a similar manner.

According to an alternative method, the first and second low friction layers 40, 42 are applied by dipping, brushing or spraying a liquid synthetic rubber coating material onto the cushion layers 36, 38. A suitable synthetic rubber coating material that can be easily sprayed, dipped or brushed on to form the low friction layers is commercially available from PDI, Inc. of Circle Pines, Minn., sold under the trademark PLASTI DIP®. That product is an air-dry synthetic rubber coating that can be easily applied by spraying, dipping or brushing, and is available in a wide variety of colors and formulations. When applying by dipping, the liquid synthetic rubber coating material is mixed with a thinner and the clamping members are dipped or immersed for five seconds. The coated parts are allowed to dry (to the touch) before applying additional coats to achieve the desired thickness.

For spraying, the synthetic rubber coating material is first diluted with a thinner, as needed. The mixture is applied in wet overlapping coats. The coating layer is allowed to dry from ten to twenty minutes before applying additional coats to achieve the desired thickness.

When applying the low friction coating layers 40, 42 by brushing, the synthetic rubber coating material is diluted with a thinner (up to thirty percent as needed). The mixture is applied in wet overlapping coats using a soft natural bristle brush. The low friction layers are allowed to dry from ten to twenty minutes (dry to the touch) before applying additional coats to the desired thickness.

Recommended thinners include toluene or naphtha. A dry film thickness of 12–15 mils is recommended for best results. The approximate dry mil thickness per coat is 6–8 mils (dipping); 4–5 mils (brushing); and 2–5 mils (spraying). Preferably, each compressible cushion layer 36, 38 is completely encapsulated within the thin, non-porous outer coating layers 40, 42, respectively. The outer coating layers provide a smooth, low-friction, non-sticking surface for directly engaging the hair without pinching or damaging the hair. That is, the soft compressible cushion layers deflect radially inwardly to form a soft yieldable pocket which securely holds onto the hair without slipping, and also without snagging or pinching the hair. The smooth, low-friction, non-sticking surfaces formed by the outer coating layers 40, 42 are also easily disengaged so that the clip can be removed from the hair without snagging.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

What is claimed is:

1. In a hair clip of the type including first and second clamping members having hair engagement surfaces, the improvement comprising:

a first layer of compressible material disposed on the hair engagement surface of the first clamping member;

a second layer of compressible material disposed on the hair engagement surface of the second clamping member;

a first layer of low-friction material disposed on the first compressible layer; and, a second layer of low-friction material disposed on the second compressible layer.

2. A hair clip as set forth in claim 1, wherein the first and second low-friction layers are constructed of a flexible material having a coefficient of friction relative to glass in the range of 0.18 to 0.26.

3. A hair clip as set forth in claim 1, wherein the first and second compressible layers comprise a cellular plastic foam.

4. A hair clip as set forth in claim 3, wherein the cellular plastic foam comprises a closed cell polyethylene foam.

5. A hair clip as set forth in claim 1, wherein the first and second compressible layers comprise natural rubber.

6. A hair clip as set forth in claim 1, wherein the first and second compressible layers comprise elastomer synthetic resin.

7. A hair clip as set forth in claim 1, wherein the first and second low-friction layers each comprise a sheet of low-friction thermoplastic high density polyethylene.

8. A hair clip as set forth in claim 1, wherein the first and second low-friction layers each comprise a synthetic rubber material that is applied to the compressible layers in liquid form by spraying, dipping or brushing.

9. A hair clip as set forth in claim 1, wherein the low-friction layers comprise a thermoplastic high density polymer blend.

10. A hair clip as set forth in claim 6, wherein the polymer comprises a high density polyethylene (HDPE) blend.

11. A hair clip as set forth in claim 1, wherein the low-friction layers comprising elastomers blended with polymer.

* * * * *